US006592476B1

(12) United States Patent
Bellehumeur et al.

(10) Patent No.: US 6,592,476 B1
(45) Date of Patent: Jul. 15, 2003

(54) HOCKEY PUCK WITH SHOCK ABSORBING RUNNERS

(75) Inventors: Alex R. Bellehumeur, 6242 Napoli Ct., Long Beach, CA (US) 90803; Neal W. Piper, Huntington Beach, CA (US)

(73) Assignee: Alex R. Bellehumeur, Long Beach, CA (US)

( * ) Notice: Subject to any disclaimer, the term of this patent is extended or adjusted under 35 U.S.C. 154(b) by 0 days.

(21) Appl. No.: 10/086,114

(22) Filed: Feb. 26, 2002

(51) Int. Cl.[7] ..... A63B 71/00
(52) U.S. Cl. ..... 473/588
(58) Field of Search ..... 473/588, 589

(56) References Cited

U.S. PATENT DOCUMENTS 5,275,410 A * 1/1994 Bellehumeur et al. ..... 473/588
5,465,966 A * 11/1995 La Savio ..... 473/588
5,597,161 A 1/1997 Bellehumeur et al.
5,718,648 A * 2/1998 La Savio ..... 473/588
5,733,213 A * 3/1998 Colarusso ..... 473/588

* cited by examiner

*Primary Examiner*—Raleigh W. Chiu
(74) *Attorney, Agent, or Firm*—Edgar W. Averill, Jr.

(57) ABSTRACT

A hockey puck with a set of runners extending from the upper and lower surface thereof. The runners are movable with respect to the puck and as the puck hits the playing surface, one or more runners strike the playing surface and move slightly inwardly with respect to the puck, absorbing some of the shock of the puck hitting the playing surface. In this way, the puck tends to bounce less away from the playing surface.

13 Claims, 3 Drawing Sheets

HOCKEY PUCK WITH SHOCK ABSORBING RUNNERS

BACKGROUND OF THE INVENTION

The field of the invention is hockey pucks and the invention relates more particularly to hockey pucks of the type used on a non-ice surface. Such pucks are often referred to as roller hockey pucks and are typically made with six runners extending from the upper and lower surface of the puck. These runners are made from a material which has a lower co-efficient of friction against the playing surface than the material from which the body of the puck is made. Most commonly, the runners are fabricated from Nylon and are positioned near the outer periphery of the surfaces of the puck.

A basic patent showing a roller hockey puck with runners is U.S. Pat. No. 5,597,161. Since the game of roller hockey is intended to play as much like as ice hockey as possible, it is desirable that the roller hockey puck have a similar action when hitting the skating surface as does the conventional rubber ice hockey puck. Pucks with runners tend to bounce more when hitting a playing surface than does a conventional ice hockey puck when striking an ice surface. Also, on rough surfaces such as asphalt, the Nylon runners tend to cause the puck to bounce along the surface more than does an ice hockey puck on an ice surface.

BRIEF SUMMARY OF THE INVENTION

It is an object of the present invention to provide a hockey puck of the type having runners which are somewhat shock absorbing in nature and, thus, bounces less than a conventional hockey puck with runners and also rides more smoothly along an asphalt or rough surface than does a conventional hockey puck with runners.

It is another object of the present invention to provide a puck and runner configuration which will reduce the contact between the puck body and the playing surface as the puck slides along the playing surface in a tilted orientation.

The present invention is for a hockey puck with a plurality of shock absorbing runners extending outwardly therefrom. The hockey puck has a hockey puck body with a generally cylindrical outer edge, an upper face, and a lower face. A plurality of shock absorbing runners are held by the puck body and extend outwardly from the upper face and a plurality of shock absorbing runners are also held by the puck body and extend outwardly from the lower face. Each shock absorbing runner has a surface contact portion. Means are provided for supporting the plurality of shock absorbing runners by the puck body which permits the movement of the surface contact portion of the shock absorbing runner inwardly with respect to the puck body when the runners are struck by an exterior force. The shock absorbing runners extending outwardly from the upper face may be connected to the shock absorbing runners extending outwardly from the lower face by connection means, such as a shaft, positioned in an opening in the puck body formed below the faces of the puck body. The means for outwardly biasing the surface contact portions may be an elastomeric foam piece positioned under the surface contact portion of the runner. Alternatively, springs may be formed by protrusions of the puck body contacting an under surface of the enlarged surface contact portion. It is also contemplated that guide pins can be formed on an upper surface of the surface contact portion, which extend into guide holes in the puck body to further position the shock absorbing runner in the puck body. The surface contact portion may be generally cylindrical as viewed from above or may be oblong in shape. The present invention is also for a hockey puck with a plurality of runners, whether they be shock-absorbing or not, having a plurality of depressions formed between each adjacent runner. The depressions permit the puck to slide along a playing surface at a greater angle while still riding only on the runners than if the depressions were absent. The runners reduce the chance that the softer puck body will contact the playing surface. The runners have a much lower coefficient of friction on the playing surface than does the puck body. The runners have a preferred shape which also includes a central depression which reduces the area of contact when the puck is resting on a horizontal surface.

DESCRIPTION OF THE PREFERRED EMBODIMENTS

Figure 1:
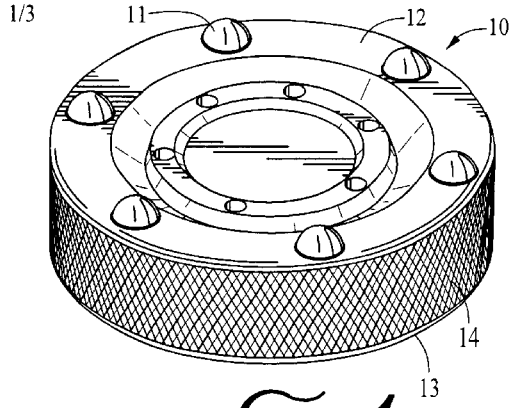
FIG. 1 is a perspective view showing an upper face and outer edge of a puck having shock absorbing runners of the present invention.
Figure 2:
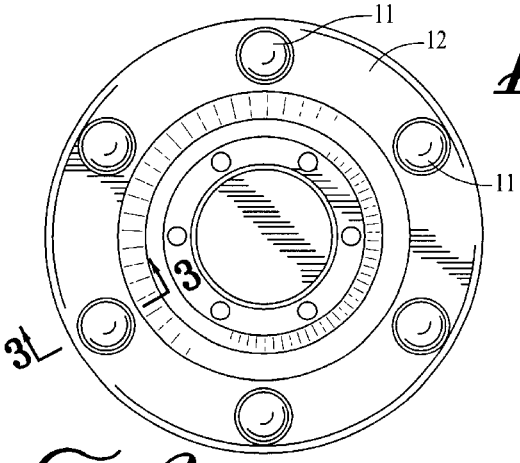
FIG. 2 is a plan view thereof.

A hockey puck 10 is shown in perspective view in FIG. 1 and has a plurality of shock absorbing runners 11 held thereby. Hockey puck 10 has an upper face 12, a lower face 13, and a generally cylindrical outer edge 14.

Figure 3:
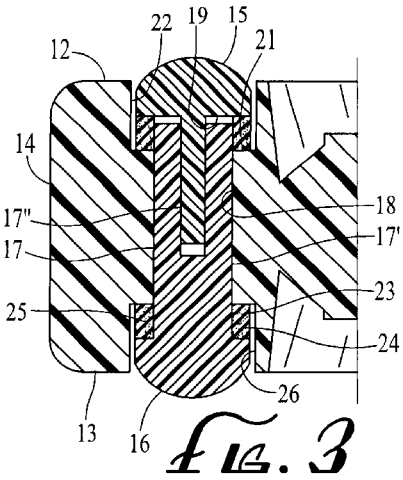
FIG. 3 is a cross-sectional view taken along line 3—3 of FIG. 2.

The details of one embodiment of a shock absorbing runner 11 is shown in FIG. 3. The shock absorbing runner has a surface contact portion 15 extending upwardly above the upper face 12 of puck 10. It has a surface contact portion 16 extending below lower face 13. Surface contact portions 15 and 16 are connected by a connector which comprises a shaft 17, which is held in an opening 18, which is larger than shaft 17, to permit the up and down movement of shaft 17 in opening 18. Surface contact portion 15 has a lower face 19 which contacts an upper elastic member 20. Upper elastic member 20 may be an elastomeric foam, a spring, or other biasing means, which urges surface contact portion 15 outwardly with respect upper face 12. Upper elastic member 20 rests on the bottom portion 21 of pocket 22, which surrounds the inner portion of surface contact portion 15.

Similarly, surface contact portion 16 is urged outwardly by lower elastic member 23, which contacts the lower face 24 of surface contact portion 16, and also contacts the bottom portion 25 of pocket 26.

It can also be seen in FIG. 3 that shaft 17 is made up of an outer portion 17' affixed to surface contact portion 16 and an inner portion 17" connected to surface contact portion 15. These two shaft portions are, of course, interconnected by friction or an adhesive, or are shaped to hold together by serrations, threads, or otherwise.

In play, when surface contact portion 16 strikes the playing surface, the lower elastic member 23 compresses, thereby permitting the surface contact portion 16 to move inwardly toward the lower face and absorb a certain amount of shock which would not be absorbed if the runner were simply fixed within the puck body. The result is that the puck does not bounce as high after landing on the playing surface and exhibits an action more like that of a conventional ice hockey puck on an ice surface. Of course, the runner operates in the same manner when the surface contact portion 15 is contacting a surface. Furthermore, when the puck is being used on a rough surface, the shock absorbing runners tend to absorb a certain amount of the roughness and cause the puck to ride more evenly over the rough surface than a puck with rigid runners.

Figure 4:
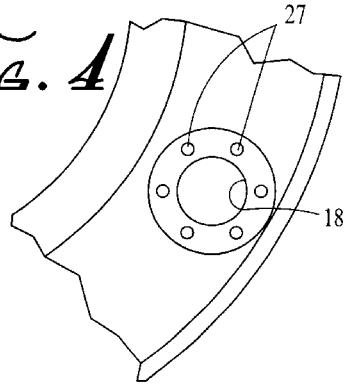
FIG. 4 is a top view of a portion of the puck of FIG. 5 showing a pocket without a runner therein.
Figure 5:
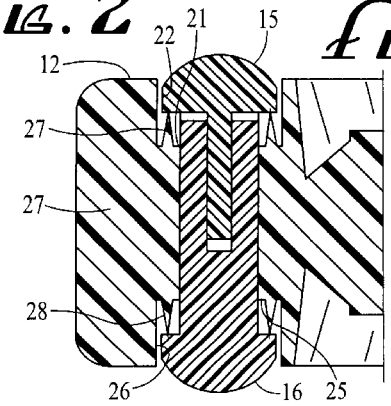
FIG. 5 is a cross-sectional view analogous to FIG. 3, but showing an alternate embodiment of the shock absorbing runner of the present invention.

There are a myriad of ways in which the runner can be made shock absorbing. Another way is indicated in FIG. 5 of the drawings where an upper set of springs are formed from the puck body 27 by a series of points molded to extend upwardly from the bottom portion 21 of pocket 22. These points or springs are shown in plan view in FIG. 4.

Similarly, a lower set of springs 28 are molded outwardly from the bottom portion 25 of lower pocket 26.

Figure 6:
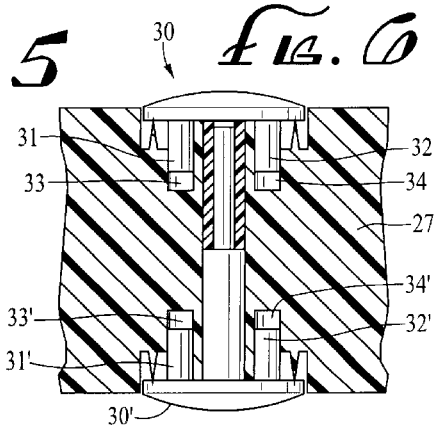
FIG. 6 is a cross-sectional view showing an alternate embodiment of the shock absorbing runner of the present invention.
Figure 7:
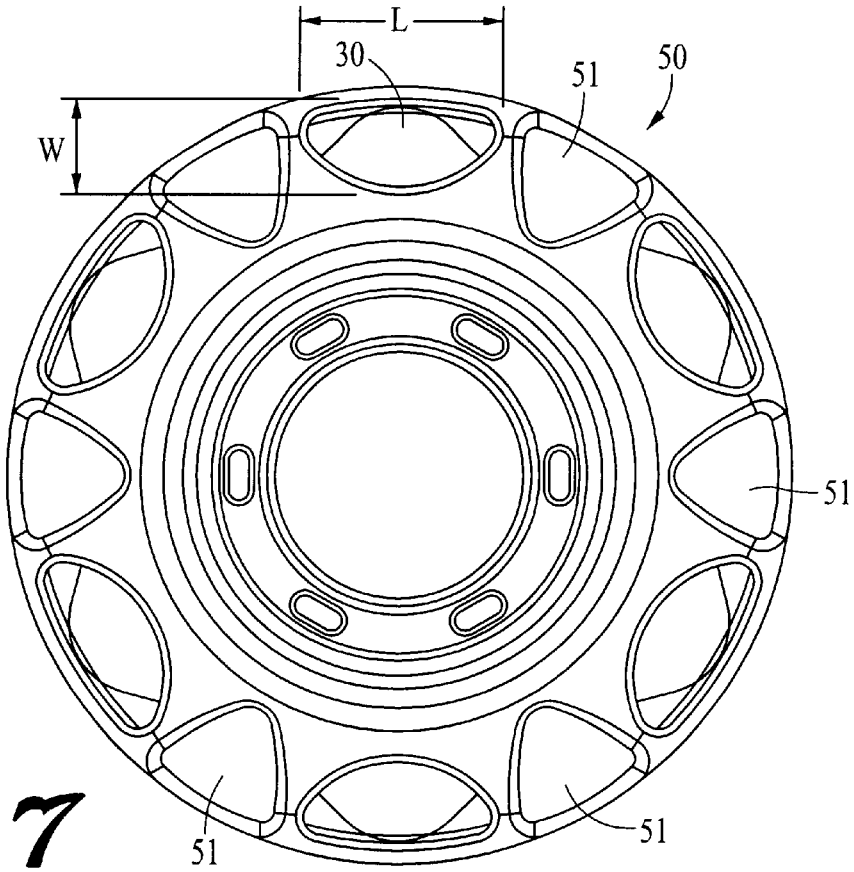
FIG. 7 is a plan view of a roller hockey puck with a plurality of the runners of FIG. 6.

The shock absorbing runners shown in FIGS. 1, 2, 3, and 5 have surface contact portions which are generally cylindrical in shape with a domed outer surface. FIGS. 6 and 7 show a runner which is generally oblong in shape. Such runner is indicated by reference character 30 and, as shown in FIG. 7, has a larger length "L" when measured circumferentially around the puck body than its width "W" as measured along a radius of the puck body. Returning to FIG. 6, shock absorbing runner 30 has two guide pins 31 and 32 which are supported in guide holes 33 and 34. Guide holes 33 and 34 are sufficiently larger than guide pins 31 and 32 so that shock absorbing runner 30 may freely move up and down with respect to the puck body 27. Shock absorbing runner 30' is essentially identical to runner 30 with the exception of the shaft configuration as shown in FIG. 6.

Figure 8:
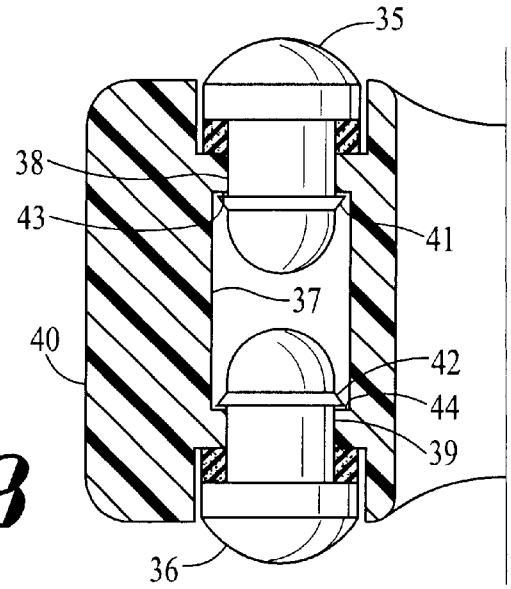
FIG. 8 is a side view partially cut away of an alternate embodiment of a shock absorbing runner.
Figure 9:
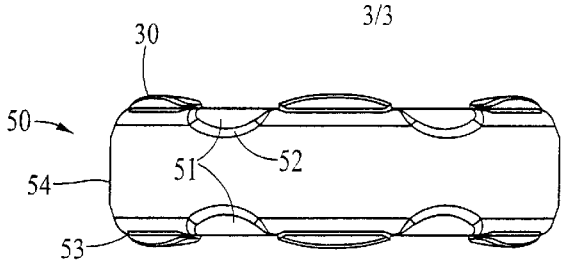
FIG. 9 is a side view of the hockey puck of FIG. 7.

While the runners in FIGS. 1–7 of the drawings are shown with the upper and lower surface contact portions being interconnected by a shaft, the design is not limited to such configuration. The upper surface contact portion may be captured by the shape of the pocket and the shape of the surface portion to act independently from the surface contact portion 16. Such a configuration is shown in FIG. 8 where runner 35 is independent of runner 36. An enlarged central opening 37 permits the inward movement of shafts 38 and 39 which are held in puck body 40 by protrusions 41 and 42 which abut the ends 43 and 44 of opening 37.

Typically, the puck runner would be fabricated from a polymer such as Nylon having a low co-efficient of friction with wood, concrete, or other roller hockey playing surface. The puck body would typically be injection molded from an elastomer, such as PVC, although the invention is in no way limited to any specific materials of construction. The term "elastomer" is intended to include any polymer or rubber which has some give or rubber-like quality so that it will bounce off a wall and can be more easily guided by a hockey stick.

Another important feature of the present invention is the configuration of the puck body shown in FIGS. 7 and 9–13. This puck body is indicated generally by reference character 50 and includes a plurality of depressions 51. These depressions are shown in side view in FIG. 9 and each depression may optionally include a chamfered edge 52. Puck 50 has an outer peripheral edge 53 and an outer peripheral surface 54 which is the typical contact area between the puck and a hockey stick.

Figure 11:
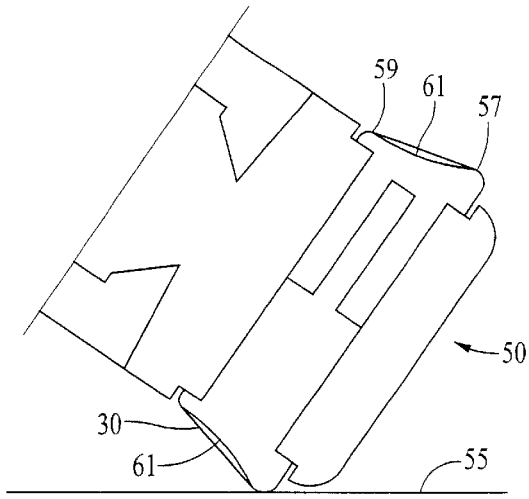
FIG. 11 is a cross-sectional view analogous to FIG. 10, except showing the hockey puck positioned at an angle from the playing surface riding on a runner head.
Figure 12:
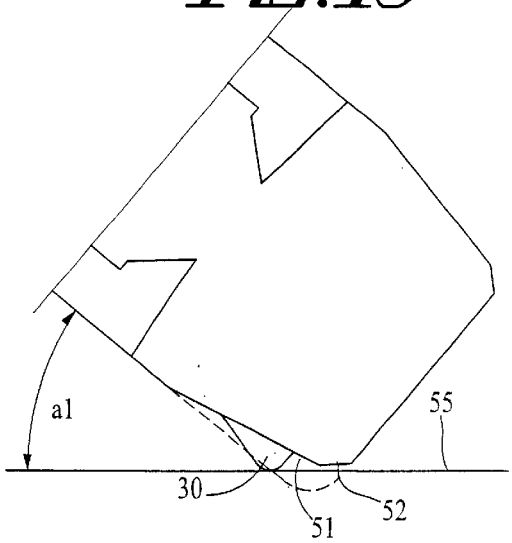
FIG. 12 is a cross-sectional view analogous to FIG. 11, except that the puck is positioned so that it rides resting on two adjacent runners showing the effect of the presence of a depression.
Figure 13:
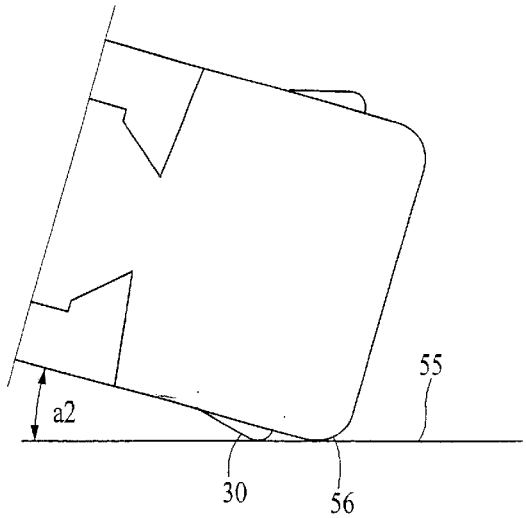
FIG. 13 is a cross-sectional view analogous to FIG. 12, except showing the puck body without a depression.

The important feature of the depressions is indicated best by viewing FIGS. 12 and 13. First, by looking at FIG. 10, it can be seen that puck 50 rides on a playing surface 55 by contact between runner 30 and playing surface 55 and the puck body does not contact the playing surface. Even when the puck tilts, as often happens during play as shown in FIG. 11, the puck still contacts playing surface 55 only through runner 30. When the puck is slightly rotated about its central axis so that it is riding at a tilt on two adjacent runners, as shown in FIGS. 12 and 13, the presence of depression 51 permits the puck to ride at a greater tilt or angle "a1" as shown in FIG. 12 than if depression 51 were absent as shown in FIG. 13. The angle "a2" without the depression, which is the maximum tilt angle without having a contact between the puck body 50 and the playing surface 55, is substantially less when the depression is not present. For example, the presence of the depression has been demonstrated to increase the tilt angle without puck body playing surface contact from 40° to 57°. The potential point of contact between the puck body and the playing surface is indicated by reference character 56. At the point when the puck body 56 contacts the playing surface 55, the puck body is much more likely to flip over since the coefficient of friction between the puck body and the playing surface is much greater than the coefficient of friction between the runner and the playing surface 55.

Preferably, each depression 51 extends across a majority or almost all of the space between adjacent runner heads. Preferably, the runner heads are somewhat oblong in shape as shown in FIG. 7, which further reduces the tendency of the puck body to rub against the playing surface. The chamfered edge 52 further decreases the tendency of the puck body to rub against the playing surface.

Figure 10:
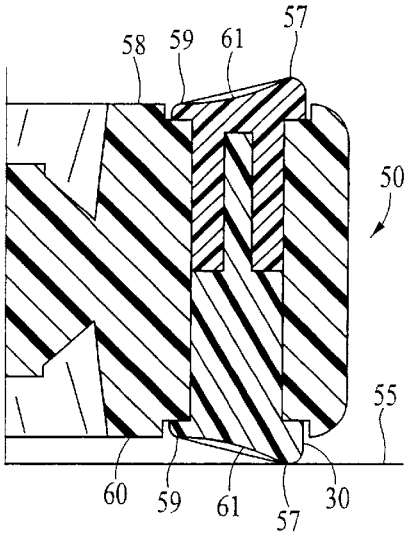
FIG. 10 is a cross-sectional view of a portion of the hockey puck of FIG. 9 resting on a playing surface.

The shape of the runner heads is also an important feature of the present invention, as shown best in FIG. 10, the outer upper edge 57 of runner 30 is farther from the upper surface 58 than is the inner upper edge 59. Similarly, the outer upper edge 57 of the lower runner is farther from the lower surface 60 than is the inner upper edge 59.

Also, each runner head has a central concave depression 61 which slopes toward the inner upper edge 59 and further reduces the contact between the runner head and playing surface 55 even as the runner begins to wear.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A hockey puck with a plurality of shock absorbing runners extending outwardly therefrom comprising:

a hockey puck body having a generally cylindrical outer edge, an upper face and a lower face;

a plurality of shock absorbing runners held by said puck body extending outwardly from said upper face and a plurality of shock absorbing runners held by said puck body extending outwardly from said lower face, said shock absorbing runners having a surface contact portion; and means for supporting said plurality of shock absorbing runners by said puck body which permits the movement of said surface contact portion inwardly with respect to said upper face for those runners extending outwardly from said upper face and permits the movement of said surface contact portion inwardly with respect to said lower face for those runners extending outwardly from said lower face which means for supporting including means for outwardly biasing said surface contact portion outwardly with respect to said puck body; and wherein each of said plurality of surface contact portions extending outwardly from said upper face is connected to a surface contact portion extending outwardly from said lower face by a connector.

2. The hockey puck of claim 1 wherein said connector is a shaft extending from each of said plurality of surface contact portions extending outwardly from said upper face to a mating surface contact portion extending outwardly from said lower face.

3. The hockey puck of claim 2 wherein each of said surface contact portions extending outwardly from said upper face is captured within a pocket formed below said upper face and each of said surface contact portions extending outwardly from said lower face is captured within a pocket formed below said lower face.

4. The hockey puck of claim 3 wherein said means for outwardly biasing said surface contact portion outwardly with respect to said puck body is an upper elastic member positioned between a bottom portion of said pocket formed below said upper face and said surface contact portion extending outwardly from said upper face and a lower elastic member positioned between a bottom portion of said pocket formed below said lower face and said surface contact portion extending outwardly from said lower face.

5. The hockey puck of claim 3 wherein said means for outwardly biasing said surface contact portion outwardly with respect to said puck body is an upper set of springs extending outwardly from a bottom portion of said pocket formed below said upper face and said surface contact portion extending outwardly from said upper face and lower set of springs extending outwardly from a bottom portion of said pocket formed below said lower face and said surface contact portion extending outwardly from said lower face.

6. The hockey puck of claim 5 wherein said sets of springs are integrally formed cones formed from said puck body.

7. A hockey puck with a plurality of shock absorbing runners extending outwardly therefrom comprising:

a hockey puck body having a generally cylindrical outer edge, an upper face and a lower face;

a plurality of shock absorbing runners held by said puck body extending outwardly from said upper face and from said lower face, each of said shock absorbing runners having two enlarged surface contact portions connected by a shaft longitudinally movably supported by an opening in said puck body; and means for supporting said plurality of shock absorbing runners by said puck body which permits the movement of said enlarged surface contact portions inwardly with respect to said upper face for those runners extending outwardly from said upper face and permits the movement of said enlarged surface contact portions inwardly with respect to said lower face for those runners extending outwardly from said lower face which means for supporting including means for outwardly biasing said surface contact portions outwardly with respect to said puck body.

8. The hockey puck of claim 7 wherein said enlarged surface portions are held in pockets formed below the upper face and the lower face of said puck body surrounding each enlarged surface portion whereby an enlarged surface portion retreats inwardly toward said pocket when said enlarged surface portion is struck against a surface.

9. The hockey puck of claim 8 wherein each of said enlarged surface portions has a plurality of guide pins extending inwardly into guide holes formed below each of said pockets.

10. The hockey puck of claim 9 wherein each of said enlarged surface contact portions has two guide pins.

11. The hockey puck of claim 8 wherein an elastic member is positioned between each of said enlarged surface contact portions and a floor of each pocket.

12. The hockey puck of claim 11 wherein said elastic member is a plurality of pins formed outwardly from a floor of said pocket into contact with an under-surface of said enlarged surface contact portion.

13. The hockey puck of claim 11 wherein said enlarged surface contact portions are generally oblong in shape being larger when measured along the circumference of said puck body than when measured along a radius of said puck body and each of said enlarged surface contact portions has a pair of guide pins extending inwardly therefrom into guide holes formed in a floor of each of said pockets.

* * * * *